US009879423B2

(12) United States Patent
Breuning

(10) Patent No.: US 9,879,423 B2
(45) Date of Patent: Jan. 30, 2018

(54) SYSTEM AND METHOD FOR BIAXIAL SEMI-PREFABRICATED LIGHTWEIGHT CONCRETE SLAB

(71) Applicant: Kim Illner Breuning, Copenhagen (DK)

(72) Inventor: Kim Illner Breuning, Copenhagen (DK)

( * ) Notice: Subject to any disclaimer, the term of this patent is extended or adjusted under 35 U.S.C. 154(b) by 0 days.

(21) Appl. No.: 14/646,758

(22) PCT Filed: Nov. 12, 2013

(86) PCT No.: PCT/EP2013/073659
§ 371 (c)(1),
(2) Date: May 22, 2015

(87) PCT Pub. No.: WO2014/079741
PCT Pub. Date: May 30, 2014

(65) Prior Publication Data

US 2015/0292203 A1 Oct. 15, 2015

(30) Foreign Application Priority Data

Nov. 23, 2012 (DK) ..... 2012 00746

(51) Int. Cl.
*E04B 1/48* (2006.01)
*E04C 5/01* (2006.01)
(Continued)

(52) U.S. Cl.
CPC ..... *E04B 5/36* (2013.01); *B28B 1/004* (2013.01); *E04B 5/328* (2013.01); *E04B 5/38* (2013.01);
(Continued)

(58) Field of Classification Search
CPC . E04B 1/161; E04B 1/163; E04B 1/22; E04B 1/215; E04B 1/41; E04B 1/48;
(Continued)

(56) References Cited

U.S. PATENT DOCUMENTS 1,979,642 A * 11/1934 Sahlberg ..... E04C 3/04 52/223.8
4,037,375 A * 7/1977 Maggos ..... E04B 5/38 249/26
(Continued)

FOREIGN PATENT DOCUMENTS

BR 1020130301434 A2 10/2014
CH 403246 A 11/1965
(Continued)

*Primary Examiner* — Phi A

(57) ABSTRACT

The present invention solves the existing problem of obtaining a self-carrying biaxial homogeneous lightweight concrete slab. The present invention consists of a system and method comprising semi prefabricated elements and special stringer structures, designed in such a way, that the finished flat slab structure appears homogeneous and can be achieved without temporary supports during the execution. The present invention solves the problem in a simple and economical manner, increasing building speed, and providing an enhanced range of applicability.

7 Claims, 2 Drawing Sheets

Figure 1:
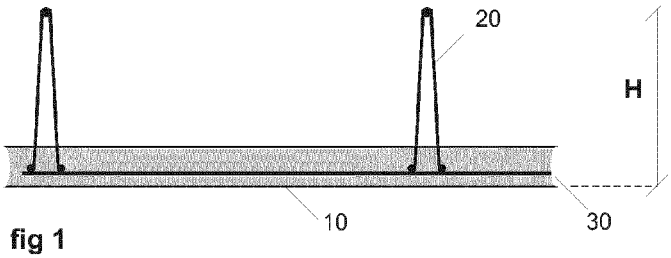

(51) Int. Cl.

| | |
|---|---|
| ***E04B 5/36*** | (2006.01) |
| ***E04B 5/32*** | (2006.01) |
| ***E04B 5/38*** | (2006.01) |
| ***B28B 1/00*** | (2006.01) |
| ***E04C 5/08*** | (2006.01) |

(52) U.S. Cl.
CPC ..... *E04C 5/01* (2013.01); *E04C 5/08* (2013.01); *E04B 2005/322* (2013.01); *E04B 2103/02* (2013.01)

(58) Field of Classification Search
CPC ... E04B 1/483; E04C 3/34; E04C 3/26; E04C 3/12; E04C 3/293; E04C 3/294
USPC ..... 52/223.6, 223.8, 223.7, 223.9, 223.11, 52/223.12, 223.14
See application file for complete search history.

(56) References Cited

U.S. PATENT DOCUMENTS

| | | | | |
|---|---|---|---|---|
| 4,494,352 | A * | 1/1985 | Leemhuis | E04B 5/38 264/256 |
| 4,627,203 | A * | 12/1986 | Presswalla | E04B 5/32 174/96 |
| 6,729,093 | B2 * | 5/2004 | Zambelli | E04C 2/2885 52/223.6 |
| 9,359,760 | B2 * | 6/2016 | Miller | E04B 5/043 |
| 2006/0075701 | A1 * | 4/2006 | Cretti | B62D 33/04 52/223.8 |
| 2007/0261329 | A1 * | 11/2007 | Rigsby | B28B 19/0092 52/223.6 |
| 2009/0301011 | A1 * | 12/2009 | Kollegger | E04B 5/28 52/223.6 |
| 2014/0013683 | A1 * | 1/2014 | Yin | E04B 5/16 52/223.6 |

FOREIGN PATENT DOCUMENTS

| | | | |
|---|---|---|---|
| CN | 102002998 | A | 4/2011 |
| CN | 102002999 | A | 4/2011 |
| DE | 6750158 | U | 1/1969 |
| DE | 3820476 | A1 | 2/1989 |
| DE | 202007007286 | U1 | 9/2007 |
| DK | PA201200746 | A | 12/2013 |
| DK | 177889 | B1 | 11/2014 |
| EP | 0027896 | A2 | 5/1981 |
| EP | 0552201 | B1 | 5/1997 |
| EP | 0794042 | A2 | 9/1997 |
| EP | 1908891 | A2 | 4/2008 |
| EP | 2325409 | A1 | 5/2011 |
| FR | 1445640 | A | 7/1966 |
| JP | 2001200520 | A | 7/2001 |
| JP | 2002339493 | A | 11/2002 |
| JP | 2003227200 | A | 8/2003 |
| WO | 1997014849 | A1 | 4/1997 |
| WO | 0053858 | A1 | 9/2000 |
| WO | 2006065085 | A1 | 6/2006 |
| WO | 2014/079741 | A1 | 5/2014 |

* cited by examiner

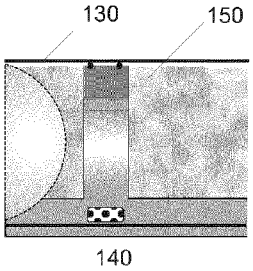
fig 8
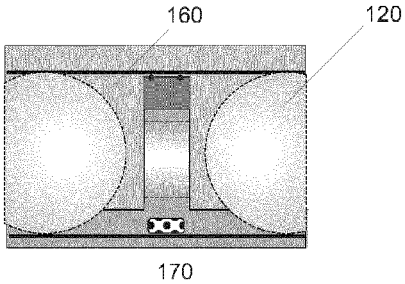
fig 9
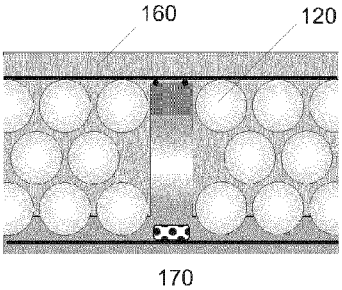
fig 10
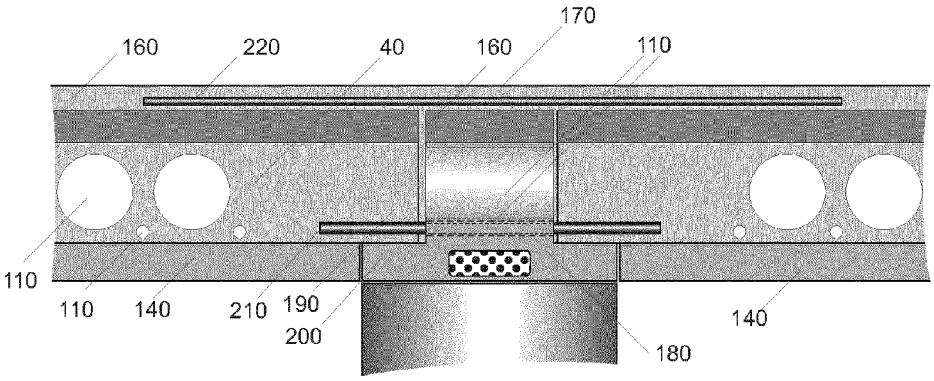
fig 11 cut a-a

SYSTEM AND METHOD FOR BIAXIAL SEMI-PREFABRICATED LIGHTWEIGHT CONCRETE SLAB

BACKGROUND OF THE INVENTION

Field of the Invention

The invention relates to the design, production and implementation of a lightweight biaxial flat plate concrete slab system, comprising semi-prefabricated elements, designed and produced in such a way, that post-tensioning of part of the system, facilitates a finished slab structure that is homogeneous and can be achieved without temporary supports during the execution.

Prior art lacks the ability to achieve homogeneous biaxial slabs without temporary supports, and the present invention solves these issues in a simple and economical manner. The enhanced range of applicability will lead to increased building speed, as well as environmental benefits through material reduction.

Description of the Prior Art

Concrete slabs can be regarded in three main groups based on the relevant criteria of function and execution: slabs fully concreted on site; fully precast elements or semi-precast elements. Each of these main groups can be divided into standard (soft steel) reinforced slabs or stressed hard steel slabs, solid or hollow/lightweight slabs, and one-way or two-way carrying slabs. The method of post-tension (PT) is used onsite at the finished concreted slab, while pre-tension is used in prefabrication. Of relevancy in relation to present system development is only the lightweight biaxial flat plate slab.

Slabs fully concreted on the building site demands scaffolding on which reinforcement can be placed and concreted. Such a slab cannot be pre-tensioned but post-tensioned by the use of tendons when concrete has hardened. After curing, the formwork can be removed. The essential weakness is the horizontal scaffolding and temporary vertical supports, which are expensive and time consuming.

Precast elements are full functional elements concreted 100% at factory and transported to the building site where to be erected without any temporary support. The weakness of fully pre-casted final elements are, that they per definition are one-way spanning elements and can only be used to achieve slabs spanning in one single direction, in contradiction to slabs concreted entirely or partly on the building site, which may be reinforced to carry in two directions. Fully precast elements are individual parts, and may have also problems with vibrations, sound and general leakage, why additional means normally are necessary.

Semi-precast elements are made on either factory or close to the building site, and normally comprises a bearing stiffening steel girder and a concrete bottom plate with basic reinforcement enabling the elements to carry their own weight in one direction during transport and implementation.

Semi-precast elements placed side by side can replace the horizontal part of the traditional formwork, and when concreted on site, after being finally reinforced, a homogeneous slab can be obtained—and as biaxial if continuously reinforced in both directions.

Even though the horizontal part of the formwork can be omitted by the use of semi-precast elements, the vertical part, the temporary supports, is still necessary, as the bearing capacity of the semi-precast elements normally is 1 to 2 m during concreting and hardening. The costs of temporary supports are 30-35% of the price for the final slab. Furthermore, the process is time consuming and demands labour for both erection and removing the supports.

In order to function, semi-precast elements have a concrete bottom of approximately 6 cm. This bottom can be applied with a weak pre-stressing, but the effect is limited, and this can only increase span between supports marginally, due to the limited height of the concrete bottom, which cannot be increased due to demands of minimising load and optimising space for voids. The essential problem is how to give a semi-precast element sufficient strength and stiffness to carry over large span—or same span as final slab—until final concreting has cured and working load can be added.

Steel profiles could be a theoretic solution, why attention is called to such examples.

Some patent applications [such as EP0794042] describe steel beams placed above the surface of a precast concrete panel and coupled to the concrete plate by various means. Placing the steel beam upon the plate opens for continuous steel reinforcing in the slab but the couplings cannot secure adequate transfer of the necessary forces between steel profile and concrete plate and besides, the effect of the steel beam itself will never be sufficient.

The lower flange of the steel beam is placed above the concrete plate and thus not encapsulated in the concrete plate. The remaining concrete cover is too thin to be stable and the contact surface between steel and concrete is too poor to transfer necessary shear forces. Increasing plate thickness is unthinkable and unrealistic as this will remove the basic idea of the slab type.

Facts are better than words—illustrated by an exact standard example with normal steel: Slab thickness 300 mm=> wanted slab span 30×thickness=9 m.

Available height=300-60−60=180 mm=> possible INP 180 (only slim profiles relevant) Disposable moment max M=W×f,yd=160000×180×10 E−6=29 kNm per profile. Slab load per 0.6 m (without safety factors) gives p=(7.2×0.75×0.6+0.2)=3.4 kN/m as no slabs have higher air-% than 25% (besides the BubbleDeck® technology as an exception). Actual design moment per profile is $M=3.4\times9^2/8=34$ kNm and more than profile strength. Steel profiles closer than 0.6 m cannot longer perform a concrete slab, but is a one-way system of parallel steel beams that cannot in practice be integrated to compose a lightweight biaxial homogenous slab.

Patent application [PCT/KR2005/004320] confirms the mentioned weaknesses.

This application describes the use of steel beams with the lower flange encapsulated in massive (thick) heavy reinforced concrete to be able to transfer the necessary forces between concrete, applied pre-tensioned tendons, and soft steel profile to compose a unity and stronger beam.

However this application complies with only regular one-way beam structures without any possibility to compose a two-way continuous homogenous concrete slab and is therefore outside the field of the present invention.

All these applications incorporating steel beam profiles are highly impracticable and expensive in material consumption, as only a part of the steel has a function. However, the most important issue—if foot of steel profile is encapsulated in a thin concrete plate with 2 cm under and 2 cm above the steel foot—is that forces (in particular post-tension) cannot be secured transferred between the vulnerable thin concrete layers and the steel, because the concrete is not strong enough and if it was, it would require additional unpractical and expensive means like complicated anchors to secure the transfer.

Patent application [WO 97/14849] describes the possibility to make fully prefabricated element with steel beams, where the elements are being prepared to be connected onsite in the main direction by tensioning tendons drawn in ducts in lines above the columns. The structure thus composes a fully prefab regular one-way long spanning TT-beam.

The construction is not a biaxial homogeneous flat slab and is not semi-prefabricated to be casted on site, and is not within the field of the present invention.

The application describes "supporting steel beams" perpendicular to the main direction. These steel beams have no bearing effect, only to support the formwork below the lifted part of bottom surface, as the concrete flange easily can carry between the ribs when concreted and hardened. Further the formwork for bottom voids can be established much simpler and cheaper e.g. by polystyrene blocks.

Patent application [WO 00/53858] describes an onsite solution where multiple secondary beams are placed within short distance from each other on primary beams. Between the secondary beams are placed lightweight blocks, and when this system is concreted, a double ribbed slab is obtained with a main (beam) direction and a secondary (beam) direction and so with no relation to a homogeneous biaxial slab. Disadvantages are that it is a time consuming system made onsite; that the traditional beams can only span a relative short distance.

Patent application [EP1908891] describes a semi-precast slab element with ridges emerging in the main direction in its end areas. Due to this, the connected slab elements will compose a regular one-way structure without possibility for any two-way effect because continuity can only be established one way, due to the obstructing ridges at the sides. The construction does not substitute a biaxial homogeneous slab, and is outside the field of actual inventions.

Further, an essential problem with this invention is the use of ridge beams.

The fabrication and concreting of a semi-precast element incorporating such ridge beams results in problematic and expensive formwork as well as process, for which reason new system/methods are needed.

Furthermore, such a fabrication method excludes the possibility to have anything incorporated in the concrete extruding from the concrete in the same direction as the ridges compared to the panel, as the semi-precast elements with ridges necessarily must be made upside-down on the formwork. As a result, neither lattice girders, nor lightweight members etc. can be placed in the concrete prior to concreting. This results in an expensive element with limited function and no flexibility. Especially lightweight members as spheres must be placed in the openings in the reinforcement mesh placed in the semi-precast bottom, in order to combine optimal weight reduction with practical fixing, as defined by the BubbleDeck® technology. For this reason, new methods are needed.

In general, prior art only describe solutions with steel extruding upwards or downwards from the ridge relative to bottom plane of panel. An example is application [2325409]. No present production method enables steel extruding both upward and downwards as described in the present application.

Another used type of slab is standard semi-precast filigree elements, where the thin bottom is applied with pre-tensioned reinforcement. However, the effect is very limited due to the thin concrete bottom and do not comply with full dead load over realistic span.

Many applications describe the use of pre-tensioned beams. However, the use of pre-tensioning is ineffective, as the ability to transfer forces between beams and thin bottom plate is very limited. This consequently limits the tension with can be applied to the beams, and as a result limits the carrying effect—and leaves the carrying effect to the beams alone.

Further, the effective height is limited to the effective height within the pre-tensioned beam itself, which furthers reduces the effect.

Patent DE 202007007286 U describes such an idea using prefabricated pre-tensioned beams, which are to be placed partly in a thin concrete plate (not stressed) to form semi-prefabricated elements. Characteristics of this application are:

a. Pre-tensioned beams
b. Ability to transfer forces between beams and thin bottom plate is very limited
c. The carrying effect of the element is consequently identical to the carrying effect of the beam
d. Carrying effect of the beam is based on its internal height, from top of beam to main steel in beam—not to any steel in the plate, which limits the effect
e. Steel extending from the beam/concrete can not take part of the pre-tensioning, but will bend, and only function effectively as vertical connector during transport and handling
f. An advantage of traditional pre-tensioned prefab beams/elements is to introduce a curvature/cambering of the beam/element, but this ability is lost by this method due to the following concreting of plate To date, there exist no solutions with regards to voided homogeneous biaxial concrete flat slabs to be erected without the use of temporary supports. The building industry needs such solution.

DESCRIPTION

The object of this development is to create a lightweight biaxial flat slab with span in any direction with at least 30× slab thickness and without temporary support. This object can be obtained through the optimal geometric balance between maximum material strength and minimum material mass (weight).

Compared to prior art, the present invention solves the time consuming and expensive process with temporary supports for semi-precast concrete slabs. The invention comprises a practical and cost efficient semi-precast building system by which voided homogeneous biaxial flat concrete slabs can be realized without the use of formwork or temporary supports—a configuration, which can be positioned directly on the buildings columns and/or walls and afterwards be fully concreted. In addition, the final slab has increased bearing capacity and improved regulation of deflection.

The key elements in the present invention are lightweight biaxial concrete slabs comprising unique semi-prefabricated stringers and semi-prefabricated concrete panels in which the semi-prefabricated stringers are integrated, and where the design allows post-tensioning tendons to be placed in an optimal way for maximum effect of post-tensioning of the entire semi-prefabricated system, while still maintaining a simple and practical solution, superior to existing art.

The semi-prefabricated stringers are carried out as a strong composite construction comprising a part with high strength reinforced concrete in order to obtain compression forces, and a part prepared for post-tensioning tendons. The stringers can be prefabricated in order to optimize process, and to allow concrete to achieve full strength, while stored for future use. The stringers are to be incorporated in semi-prefabricated elements, which can be executed in factory or next to the building site. The incorporation is practical, flexible and inexpensive, compared to prior art.

The semi-prefabricated stringers contains partly exposed steel extruding outwards in two opposite directions from the concreted part of the stringer, thus enabling both steel for integration in bottom of element, positioning of tendons, and distribution of forces from later post-tensioning, as well as flexibility in connection of top mesh. These exposed steel bars must be placed in a specific way, in order to allow practical fabrication without difficult and expensive formwork. Only this specific execution, where part of the steel is placed in either longitudinal groves in the formwork, where only part of the steel bars cross section is embedded herein, or otherwise free from being concreted, fulfils these demands for flexibility in connection of top mesh. Traditional ways of letting steel extent out from the concrete beam do not achieve this, as the steel extending outwards from the concrete is not continuously present along the beam, which is required, as the position of the crossing steel bars in the top mesh, to be placed later on in the process, is not known. The steel extruding outwards from the concreted part of the stringer, in the opposite direction than the steel intended for connection of top mesh, is designed in such a way, that it enables integration of stringer in bottom of element, positioning of tendons, and distribution and optimization of forces from later post-tensioning.

After incorporation of the semi-prefabricated stringers and concreting of the semi-prefabricated element, this system can be post-tensioned. As the semi-prefabricated stringers is made in an earlier production process, the concrete in these stringers has obtained full concrete strength, allowing for higher amount of the post-tensioning to be applied, and consequently allowing for longer spans in the construction phase.

Both the design of the special stringer structure and more importantly the entire principle is fundamentally different from prior art. The current application describes the use of post-tension, which is to be applied to the semi-prefabricated elements after the special semi-prefabricated stringer structures, with cured strong concrete, are connected to bottom steel and both are concreted together in order to create a united system.

Only the method of applying post-tension after concreting and on the entire cross section of the elements (stringers plus plate), will a. solve problems with transferring sufficient stresses between stringer and plate, and allow to operate with much higher forces
b. Allow the use of pre-cured concrete, which has obtained full strength
c. Increase the effective height, from top of stringer/rib to reinforcement in plate
d. create sufficiently bearing capacity for practical use (span up to 10 m)
e. enabling applying a curvature/cambering of the semi-prefabricated element In order to utilize this method, the design of the stringer structure must enable space and correct position of tendons. Steel must be designed and positioned, so integration to bottom plate is sufficient, even after applying post-tensioning to the system. The design also allows for tendons placed with a varying vertical position for optimal effect. This is only possible by use of post-tensioning. Pre-tension will lead to straight cables with reduced effect.

Further, the system must be designed to integrate void formers in an effective way, in order to maximize weight reduction, while still maintaining a practical and cost efficient production process.

The semi-prefabricated elements are created with the same relative carrying capacity and stiffness as full-casted carrying elements, why the elements and the system can achieve the same span range as for pre-prefabricated final elements.

The individual semi-prefabricated elements carries in the slabs main direction, and can carry the full execution load (self-load and concrete to be poured) in their full span with no temporary supports. At slab ends, the elements can be placed on special semi-prefabricated components acting in the secondary direction of the slab. These special components have the same structure as a semi-precast element comprising a special stringer.

After final concreting of the system, a biaxial flat plate slab is obtained, in which the carrying effect has changed from acting in one direction in a semi-precast element to an biaxial effect acting in arbitrary direction in a fully homogenous biaxial slab. Fast and efficient executed without temporary supports.

The invention is unique. Firstly, because design and intended use of the semi-prefabricated stringers is unique. Secondly, because idea and method, comprising post-tension of the semi-precast system of plate and ribs, is completely different from prior art. Thirdly, as the process is novel, from factory process, comprising a two-step method where the critical part is cured before post-tensioning, to final execution, enabling a homogenous slab without use of temporary supports. The incorporation is practical, flexible and inexpensive, compared to prior art, as the semi-precast elements can be concreted on a simple plane formwork instead of making a special formwork and concreting the elements upside-down. This is a key point of the present invention, as it maximises flexibility and degree of utilization, while minimizing costs. It also secures that lightweight members can easily be incorporated maintaining optimal position and geometry according to known standards.

The present invention also describes a method for practical production.

It must be noted, that prior art, which incorporates pre-tensioned beams, cannot be converted to make use of post-tension instead, due to both the design and method, which requires a two-step production of first semi-prefabricated stringers which are to be integrated in semi-precast panels in step two. A person skilled in the art can neither change prior art into effective post-tensioned systems, nor use his skills to provide an effective post-tensioned solution.

The general comprehension of post tension is that it is a method to be used insitu, while pre-tensioning is used in precast members. The idea of using post tension in semi-precast slab systems, and especially as in the present invention, is novel.

The combination of design, incorporation of void formers (spheres) and importantly the use of post-tension, gives an effect and efficiency, in terms of span as well as rational production, that is unparalleled and novel.

DETAILED DESCRIPTION OF THE INVENTION

The invention comprises a practical and cost efficient semi-precast element system with which lightweight homogeneous biaxial concrete slabs can be realized without the use of formwork or temporary supports—a configuration, which can be positioned directly on a buildings vertical supports as columns or walls, and afterwards be connected by final concreting. In addition, the final slab has increased bearing capacity and improved control of deflection and cracking.

The key elements in the present invention are lightweight biaxial concrete slabs comprising unique composite semi-prefabricated stringers and semi-precast concrete elements in which the semi-precast stringers are integrated, and where post-tension tendons in the stringer are placed in an optimal way for maximum effect of post-tensioning of the semi-precast system, while still maintaining a simple and practical solution.

FIG. 1 illustrates a cross section cut in a traditional semi-precast element, where a thin concrete bottom plate (10) is given a certain carrying capacity by implementing steel lattice girders (20), which is placed on the bottom reinforcement (30) and integrated in the concrete bottom. These lattice girders enable the semi-precast element to be transported, lifted and to span 1-2 meters between lines of temporary supports. The concrete bottom (10) constitutes a bed for later supplementary final concreting.

FIG. 2-11 illustrate construction principles and construction method of the present application.

Figures 2, 3:
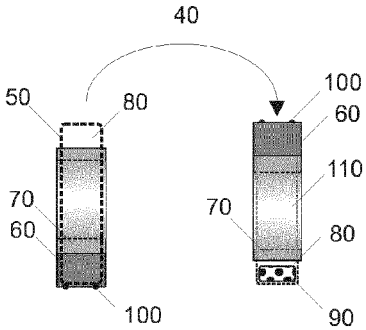

FIG. 2-3 describes the principle in the special stringer (40) structures which substitutes normal steel lattice girders (20). The semi-prefabricated stringers (40) are carried out as a composite construction comprising a) a steel arrangement (50), sufficient to transfer proper forces between a future concrete plate (10) and stringer (40), and b) a part (60) with a special composite mix of high strength concrete and reinforcement in order to obtain maximum compression forces, and c) a part with standard concrete (70), and d) an open part (80) prepared for post tensioning tendons (90) to secure necessary tension forces.

Firstly, the steel arrangements (50, 100) are placed in in a formwork. The steel bars (100) must be placed in a specific way, in order to allow practical fabrication without difficult and expensive formwork, and also to enable flexibility in future onsite connection of top reinforcement (130). Only a specific execution where steel extrudes partly from the concrete part (60) fulfils these demands. One specific method is to place steel in longitudinal groves in the formwork, where only part of the steels cross section is embedded herein. Another specific method is placing a steel profile with one plane face directly above the formwork, so this face will be visible after concreting. Traditional ways of letting steel extent out from the concrete beam do not achieve this, as the steel extending outwards from the concrete is not continuously present along the beam. And this is required, as the position of the steel to be placed later on in the process is not known at this stage.

Secondly, a steel arrangement (50), sufficient to transfer proper forces between a concrete plate (10) and stringer (40), is placed inside the formwork. The vertical part of the steel arrangement (50) which protrudes into an open part (80) can either be made as closed cages, or open upwards, thereby providing extra freedom throughout the following production processes.

Thirdly, a layer (60) of approximately 20% of final stringer height is concreted around a special high strength steel core and using (ultra) high strength concrete, and leaving partly exposed steel bars (100) from the bottom arrangement prepared for future steel connections at slab top. The basic high strength core (60) will form the top of the stringer when turned and implemented in a semi-precast element. The core has increased compression strength of up to 8 time's normal concrete strength and can individually obtain the compression forces of the slab moment.

Fourthly, if the first pouring of concrete (60) leaves space, standard concrete (70) is poured to reach the final pre-cast height (H) minus app 90% of the thickness of bottom plate (10) and so leaving an open space (80) inside the remaining steel arrangement (50) for later implementing of high strength steel as tendons (90). To this pouring can be used standard concrete as an option to save money, as high strength concrete is not needed in this section, but with the actual small volumes it is acceptable and maybe even preferable to concrete fully in strong concrete and save one operation.

Openings or voids (110), perpendicular to lengthwise direction of stringer (40) structure, can be integrated in this part of the stringer (40). The preferably circular openings (110) can be incorporated in order to obtain weight saving and thereby ease for handling and to allow for installations and possibly on site crossing reinforcement. Further the openings will secure stronger integration between on-site concrete and stringer. Additional openings/penetrations can be implemented.

After the concrete is hardened, the stringer (40) can be stored for later use.

The system is practical and flexible as the stringers (40) can be made in a separate standard production and the concrete can achieve 100% strength while storing, which means that the stringers at any time and with immediate full concrete strength and applied with, but not limited to, relevant post-tension tendons (90), can be directly implemented in a semi-precast element bottom by simply being concreted together with the bottom plate (10). The execution can be done either in factory or next to the building site. After hardening, necessary post tension can be applied and the semi-prefab element is ready for use.

FIG. 3 illustrates the optimal position of tendons. Tendons (90) can be placed either within the concrete (60, 70) in the stringers (40), or within a closed steel arrangement (50) protruding from the stringer (40), or between an open steel arrangement (50) protruding from the stringer (40) and a bottom reinforcement (30), where the design of the steel arrangement (50) is essential as it must allow for a proper transfer of forces between stringer (40) and the concrete bottom (10) of the element. The chosen version will depend on practical factors, but the most efficient is to place the tendons (90) as close to the bottom reinforcement (30) as possible and directly below the stringers (40) in order to optimize the effect. Vertical position of tendons can vary along the stringer for optimized effect of post-tensioning.

Figure 4:
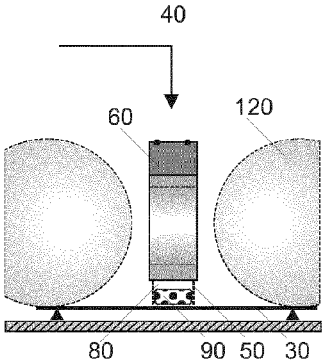
Figure 5:
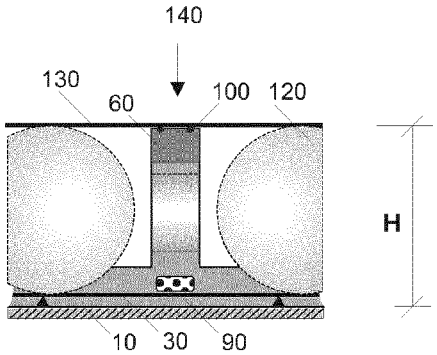

FIGS. 4 and 5 show the fabrication of the semi-precast elements. Bottom reinforcement (30) is placed on spacers on a traditional formwork. Stringers (40) are then placed bottom side up with the high strength core (60) turning upwards and steel arrangement (50) for the tendons (90) turned downwards. The stringers can be placed either on spacers, or preferable directly on the bottom reinforcement (30). The tendons (90) are preferable straight but the end parts can be placed with a slight angle to ease the practical work, and increase the effect. Then, lightweight members (120) as, but not limited to, hollow spheres can be placed above the bottom reinforcement (30), in order to obtain maximum reduction of concrete. If lightweight members are placed at this stage, a thin mesh of top reinforcement (130) can be placed in order to fix and maintain the position of lightweight members. The top reinforcement (130) can be attached or welded to the steel (100) extruding from the stringer (40). Fixing or welding the top reinforcement (130) to the top of the stringers (40) is an effective mean for holding the lightweight members (120) in the prescribed position even during concreting to prevent floating due to uplift Next, a layer of concrete (10) is gently and skilfully distributed thus covering bottom reinforcement (30) and the open part of the steel arrangement (50) with tendons (90), extending downwards from the stringer (40) structure, thereby composing a semi-prefabricated element (140) structure shaped as a turned T, or a number of Ts. Alternatively, bottom reinforcement (30), tendons (90) and stringers (40), and if chosen also lightweight members (120) and top reinforcement (130), can be lowered into an already poured layer of concrete (10). The succession of procedure is flexible and can be adjusted to the circumstances. After hardening, the element (140) is ready for storing or direct use.

Depending on needed strength, the elements (140) can be carried out with any combination of bottom reinforcement (30) and tendons (90). The element, comprising plate bottom (10) and stringers (40), is post-tensioned by applying tension stress in the tendons (90) already incorporated in the concrete. After hardening and post-tensioning, is obtained a semi-prefabricated element (140) with sufficient strength to act as self-carrying scaffolding for full concrete slab load at a span at least 30 times slab thickness.

Figure 6:
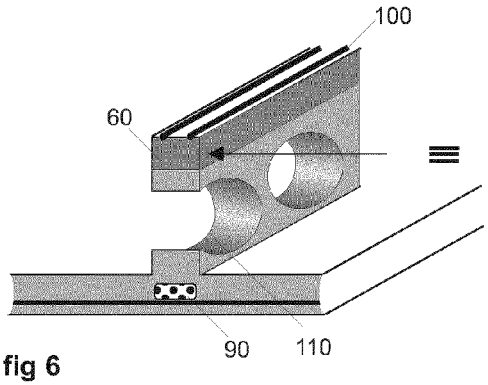
Figure 7:
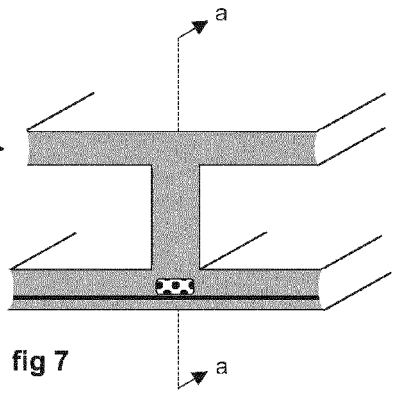

FIGS. 6 and 7 illustrates the effect of the high strength composite head. FIGS. 6 and 7 are an identity, where FIG. 7 shows the H-effect and actual execution if standard concrete profile should have been used, as the stringer core has 8 times normal strength. With the current design, a practical, extreme flexible and time-saving solution is obtained with extended space for implementing light materials saving 50% of the concrete.

FIG. 8 shows the basic semi-prefabricated element (140) with filling of arbitrary light material (150) and/or light weight members (120) as hollow spheres. The light weight members can be arranged in layers if more practical. After placing the light weight material (150) the top reinforcement (130) can be installed, either on factory or on site, and fastened to the partly exposed steel rods (100) in the top of stringers (40).

FIGS. 9 to 10 show cross sections of semi-prefabricated lightweight elements (140), equipped with lightweight members (120) placed in a geometrical cell structure between the stringers (40), and embedded in a final layer of concrete (160), thus obtaining a final concreted slab (170). If using lightweight members (120), these can be placed either before or after concreting the bottom (10) depending on the desired design, but preferable before. If using hollow volumes as spheres, with space for concrete between them, is obtained a homogeneous (geometric porous) concrete mass in the full slab thickness resulting in a light "massive" slab as full massive strength like a solid slab is maintained.

Using maximum lightweight elements is essential in order to achieve long spans without temporary supports. The present invention constitutes the absolutely lightest biaxial floor—and without loss of strength.

Concreting can be done in one or more steps depending on slab thickness.

FIG. 11 shows a longitudinal cut in a fully concreted semi-precast element/slab (170). The semi-prefabricated elements (140) can, before final concreting, be installed in the construction side by side, supported at their ends on any form of support, but preferably on a semi-prefabricated component (180) of same composition as semi-prefabricated element (140) acting as a supporting component, placed and spanning between permanent vertical structural supports as columns and/or walls.

A part of the stringers (40) in the individual element (140) protrudes out from the full semi-prefabricated element (140) so this protruding part (190), can land on the bottom flange (200) of the supporting component (180), designed so the bottom surface of the elements (140) levels the bottom surface of the supporting component (180), thus creating a completely flat plate slab with uniform bottom level.

These supporting components (180) are designed so bottom connection reinforcement bars (210) of sufficient length can be placed on the bottom (10) through opening in the stringer (40) of the supporting component (180) between two neighbouring elements (140).

After placing connection reinforcement bars (220) at the top across the elements (140), the full configuration can be finally concreted and a fully biaxial lightweight homogeneous flat plate slab is obtained without the use of any temporary supports.

REFERENCE LIST FOR DRAWINGS

10. Flat concrete bottom
20. Steel girder
30. Bottom reinforcement
40. Semi-prefabricated stringer
50. Reinforcement arrangement
60. Zone with high strength composite concrete
70. Zone with standard concrete
80. Open volume
90. Tendons
100. Protruding steel
110. Voids in stringer
120. Lightweight filling members
130. Top reinforcement
140. Semi-prefabricated lightweight element
150. Arbitrary lightweight fill
160. Final concrete fill
170. Completed lightweight slab
180. Supporting component
190. Protruding part of stringer
200. Protruding bottom flange of supporting component
210. Connection reinforcement in bottom
220. Connection reinforcement in top

The invention claimed is:

1. A biaxial lightweight concrete slab system, comprising semi-prefabricated elements, characterized in that said elements (140) are self-carrying, each incorporating a bottom (10) functioning as a slab formwork and further incorporating semi-prefabricated stringers (40) integrated in the bottom of said elements (140) and comprising a high strength composite zone (60) of reinforced concrete with a steel arrangement (50) protruding from the concrete surface of said stringers (40) towards a bottom reinforcement (30), and an open zone (80) allowing the installation of post-tension tendons (90) enabling an optimized effect of post-tension, which is applied after concreting of the elements (140), the post-tension tendons (90) being positioned in said elements (140) such that the stringers (40) and the concrete bottom (10) provide full carrying capacity in one direction over the main span for the final dead load, and in that said slab system comprises a final concrete slab (170) acting as a biaxial homogeneous plate with carrying capacity according to the design load on the slab, and in that the system comprises lightweight members (120) as hollow spheres placed in a geometrical grid.

2. The biaxial lightweight concrete slab system according to claim 1, characterized in that the stringers (40) incorporate the steel arrangement (50) in the lengthwise direction of the stringer (40), and where a part of a steel arrangement (100) is exposed, in the direction opposite to the protruding steel arrangement (50) relative to the concrete, and prepared for future connections at the top, enabling a top reinforcement (130) to be welded or otherwise connected to said steel arrangement (100).

3. The biaxial lightweight concrete slab system according to claim 1 or 2, characterized in that openings (110) perpendicular to lengthwise direction of the stringer (40) are integrated in the stringer (40).

4. The biaxial lightweight concrete slab system according to claim 1 or 2, characterized in that the self-carrying semi-prefabricated elements (140) are made partly with a material other than concrete.

5. The biaxial lightweight concrete slab system according to claim 1 or 2, characterized in that a supporting element (180) with a similar stringer (40) provides spanning between permanent vertical structural supports as columns or walls, and supports the end of the series of the elements (140), and after final concreting of the system acts as an integrated part of a functional and geometrical unity with the elements (140) creating a biaxial homogeneous slab (170) obtained with no temporary supports.

6. The biaxial lightweight concrete slab system according to claim 1 or 2, characterized in that the stringer or a part of the stringer (40) in the elements (140) protrudes out from said elements (140) such that a protruding part (190) of said elements (140) lands on a bottom flange (200) of the supporting element (180) designed such that the bottom surface of said elements (140) is on the same level as the bottom surface of the supporting element (180), thus creating a completely flat plate slab with uniform bottom level, and which, after placing joint splice bars across the bottom reinforcement (210) and the top reinforcement (220), and after a final concreting (160) of the system, creates the biaxial homogeneous flat plate slab (170) obtained with no temporary supports.

7. The biaxial lightweight concrete slab system according to claim 1 or 2, characterized in that the tendons (90) are placed with varying vertical positions within the supporting element (180).

* * * * *